US006614150B2

(12) United States Patent
Huang

(10) Patent No.: US 6,614,150 B2
(45) Date of Patent: Sep. 2, 2003

(54) NON-DETACHABLE STRUCTURE OF A LAMP BULB AND ITS LAMP HOLDER

(75) Inventor: Peter K. H. Huang, Taipei (TW)

(73) Assignee: Shining Blick Enterprises Co., Ltd., Taipei (TW)

( * ) Notice: Subject to any disclaimer, the term of this patent is extended or adjusted under 35 U.S.C. 154(b) by 1 day.

(21) Appl. No.: 10/054,901

(22) Filed: Jan. 25, 2002

(65) Prior Publication Data

US 2003/0141799 A1 Jul. 31, 2003

(51) Int. Cl.[7] ..... H01J 5/48

(52) U.S. Cl. ..... 313/318.01; 313/318.1; 313/318.12

(58) Field of Search ..... 313/318.01, 318.05, 313/318.09, 318.1, 318.12

*Primary Examiner*—Vip Patel

(74) *Attorney, Agent, or Firm*—Troxell Law Office PLLC

(57) ABSTRACT

A non-detachable structure of a lamp bulb and its lamp holder, the lamp bulb is connected in advance with a bottom connecting member, two conductors for a tungsten filament in the lamp bulb are bent and positioned onto two lateral sides of the bottom connecting member to electrically contact two metallic contact pieces on a power line when the lamp bulb is insertion connected with a lamp holder; the lamp holder is provided at the top of an opening thereof in corresponding to an upper edge of the bottom connecting member with an engaging mechanism, thereby, the lamp bulb and the bottom connecting member form safe engagement against random detachment. Thereby, the lamp bulbs with various loops can be prevented from direct detaching by a user.

5 Claims, 6 Drawing Sheets

NON-DETACHABLE STRUCTURE OF A LAMP BULB AND ITS LAMP HOLDER

BACKGROUND OF THE INVENTION

1. Field of the Invention

The present invention is related to a non-detachable structure of a lamp bulb and its lamp holder, and especially to such a structure of a lamp bulb and its lamp holder capable of preventing a user to detach by himself for changing when the lamp bulb is damaged.

2. Description of the Prior Art

Conventional decorative lamps such as Christmas lamp strings mostly have linear specific lengths; they can illuminate or flash through the function of lightening of the lamp bulbs thereon. Such conventional lamp strings can only give quite limited variation, for example, they can only be pulled to form a letter "V" or wrapped around a Christmas tree. Therefore, people design some imitative shapes of articles (such as stars, Christmas trees etc.) as frames, then lamp beads are mounted on the frames one by one, thereby, the are provided with the decorative shining function as stars or Christmas trees are. However, their effects of lamp variation are still limited, and the volumes of the imitative frames are overly large, packaging and transportation of them are inconvenient.

In the recent years, decorative lamps in the form of net lights or knitting lights are produced to breakthrough the aforesaid limitation, In such a net light or knitting light; the largest function thereof is that it can be individually hung for decoration, or it can be stuck to a flexible base plate, on the base plate, there is a desired pattern depicted, The lamp string can be combined with the flexible base plate, the pattern of the entire decorative lamp string can thus be more variant, the lamp string can be wrapped to reduce its occupying volume. And the net light or the knitting light is convenient for direct wrapping around a decorative article (such as a Christmas tree). Such net light or knitting light has the aforesaid advantages, nonetheless, variation of lamp flashing of the entire light still can only be decided by different flashing rate or different colors of the lamp beads, its function of illuminating and decorative flashing is still inadequate.

Accordingly, U.S. Pat. No. 5,951,146 provided a net light including therein a braided pattern, of which the entire net plane is formed by intercrossing braiding a plurality of lamp strings individually with a loop. The lamp strings each can form any of various randomly designed patterns and letters by selective arrangement of the lamp beads and a lamp string, and the lamp strings can be controlled by separately turned on/off by means of the separated switches for the lamp strings having a monocrystalline integrated electric circuit provided with a control program; so that driving of the program of the integrated electric circuit forms a single sequential or intermittent output, and that the a plurality of lamp strings can generate more variant flashing correspondingly, and the entire knitting decorative lamp can provide the decorative function of having more flashing patterns or letters.

Such decorative net light formed by the lamp strings individually with a loop has each of the loops comprised of different number of lamps bulbs. For example, if one of the loops forms a larger lamp string pattern, its number of lamp bulbs will be larger; on the contrary, smaller pattern needs fewer lamp bulbs. Assuming that each lamp string is supplied by a power source of same voltage, the voltage of each lamp bulb serially connected in every individual loop is different, for example, if a lamp string with 10 lamp bulbs is supplied with a voltage of 220 V, then the voltage of each lamp is 22 V. While for a lamp string with 20 lamp bulbs, the voltage of each lamp is 11 V.

From the difference stated above, when a lamp bulb of the above stated lamp strings with a plurality of separated loops is damaged, a lamp bulb with the same value of resistance with that of every other lamp bulb in the corresponding lamp string with its individual loop is substituted for it. A decorative net plane may have lamp bulbs of multiple different values of resistance, a common user is uneasy to distinguish for detaching them. But lamp bulbs and their lamp holders now available are all detachable, a user detaches by himself may induce worrying of safety in using the lamp bulb products.

SUMMARY OF THE INVENTION

The object of the present invention is to provide a non-detachable structure of a lamp bulb and its lamp holder, wherein, an engaging mechanism is provided at the joint of a bottom connecting member of the lamp bulb with the lamp holder, when the two are connected at the joint, the lamp bulb can be prevented from direct detaching from the lamp holder by providing the engaging mechanism.

In one of the feasible embodiments, the above stated engaging mechanism includes an inner peripheral annular rib which allows a corresponding annular flange provided on the bottom connecting member of the lamp bulb to be forcedly pressed into engagement therewith.

In another one of the feasible embodiments, the inner peripheral annular rib is substituted by a plurality of intermittently arranged protruding points.

And in another one of the feasible embodiments, the inner peripheral annular rib is substituted by a bevel inner groove, and the corresponding annular flange provided on the bottom connecting member of the lamp bulb is beveled in corresponding to the bevel inner groove in obliquity for engagement with the inner groove.

In a further one of the feasible embodiments, the engaging mechanism including is provided on the top of the opening of the lamp holder with an outer peripheral annular flange, while the bottom connecting member of the lamp bulb is provided with a corresponding engaging flange for engaging with and locking the annular flange.

The present invention will be apparent in its novelty and features after reading the detailed description of the preferred embodiment thereof in reference to the accompanying drawings.

DETAILED DESCRIPTION OF THE PREFERRED EMBODIMENT

Figure 1:
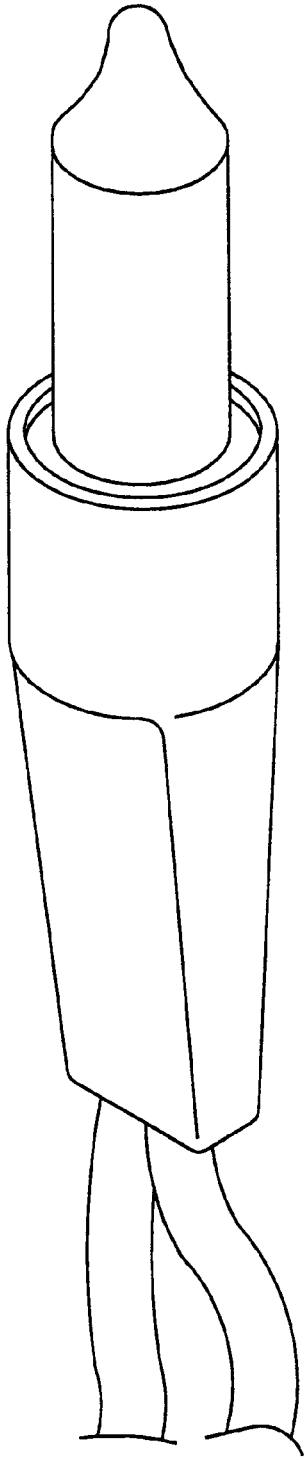
FIG. 1 is a perspective view of the first embodiment of the present invention.
Figure 2:
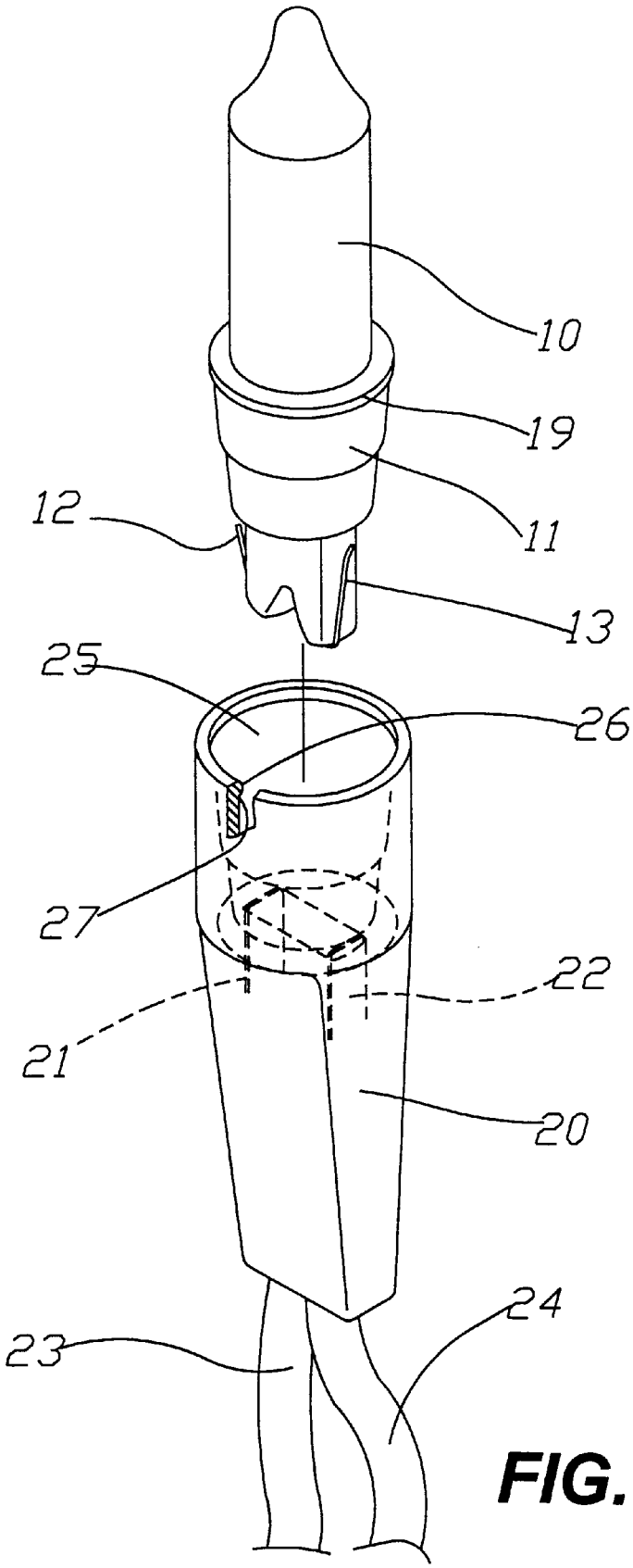
FIG. 2 is an analytic perspective view of a lamp bulb and its lamp holder as shown in FIG. 1.
Figure 3:
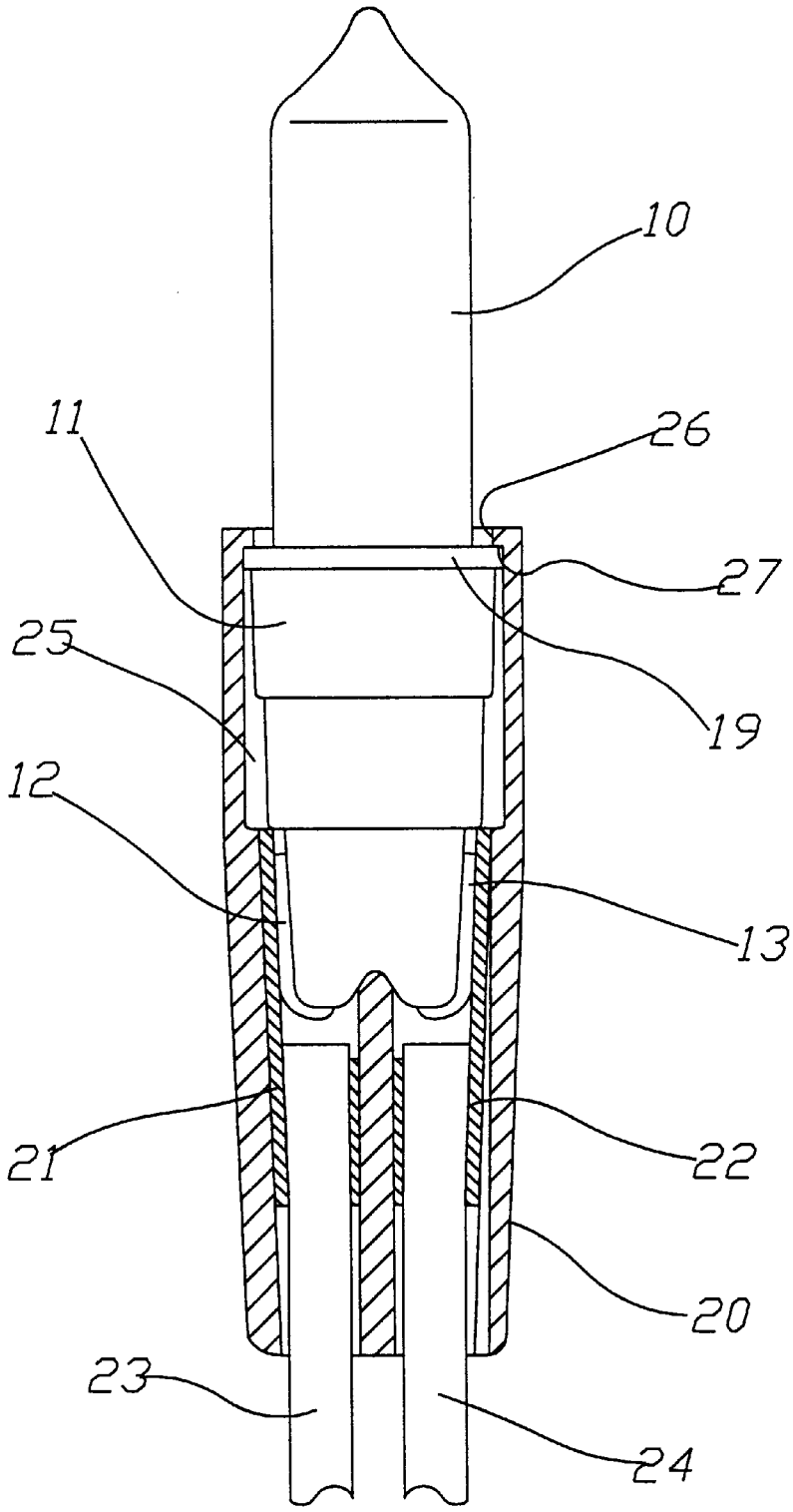
FIG. 3 is a sectional view taken from FIG. 1.

Referring to FIGS. 1–3, in the preferred embodiment of the present invention, the lamp bulbs 10 widely used on a Christmas lamp string or on a decorative lamp string are positioned in the first place on a bottom connecting member 11 made of insulation material, thereby, the two conductors 12, 13 in each lamp bulb lamp bulb 10 are exposed and bent onto the two lateral sides of the bottom connecting member 11. The entire lamp bulb 10 and its bottom connecting member 11 can thus be inserted into a corresponding lamp holder 20 to make the two conductors 12, 13 be pressed against two metallic contact pieces 21, 22 in the lamp holder 20. Electric current provided by the electric power flows from two conductors 23, 24 under the lamp holder 20 via the metallic contact pieces 21, 22, the two conductors 12, 13 and through a tungsten filament in the lamp bulb 10 to form a loop.

The present invention is characterized by that, the above-mentioned lamp holder 20 is provided at the top of an opening 25 for insertion of the lamp bulb 10 and the bottom connecting member 11 (which top is provided in corresponding to the upper edge of the bottom connecting member 11) with an engaging mechanism. In the embodiment shown in the drawings, the top of the lamp holder 20 is provided with an inner peripheral annular rib 26 forming an engaging shoulder 27; while the upper edge of the bottom connecting member 11 is provided with a corresponding annular flange 19. So that when in insertion connecting the bottom connecting member 11 and the lamp bulb 10, the bottom connecting member 11 and the lamp holder 20 both made of insulation material such as plastic or the like will allow the annular flange 19 to be forcedly pressed to get through the inner peripheral annular rib 26 in the first place, and then to be engaged in the engaging shoulder 27. Thereby, the non-detachable engaging mechanism is formed.

Figure 4:
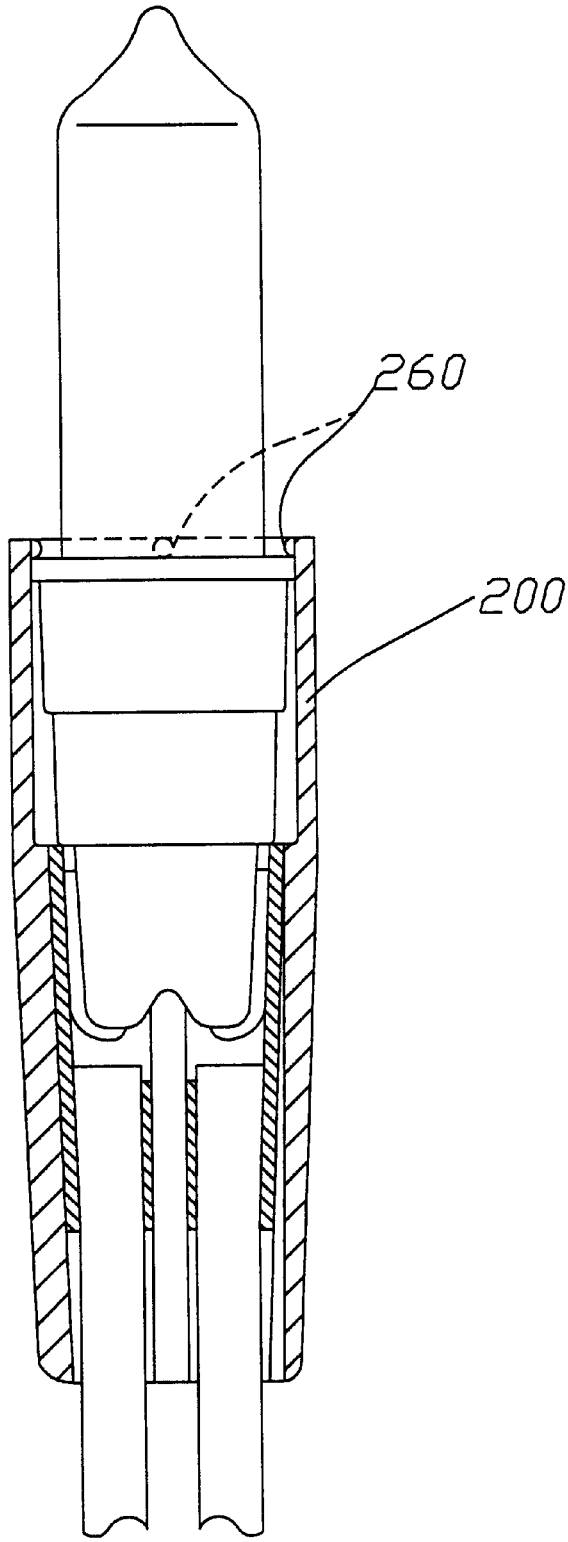
FIG. 4 is a perspective view of the second embodiment of the present invention.

In the second embodiment of the present invention as shown in FIG. 4, the opening of a lamp holder 200 is provided on the inner periphery on the top thereof with a plurality of intermittently arranged protruding points 260 in substitution for the inner peripheral annular rib 26 of the first embodiment.

Figure 5:
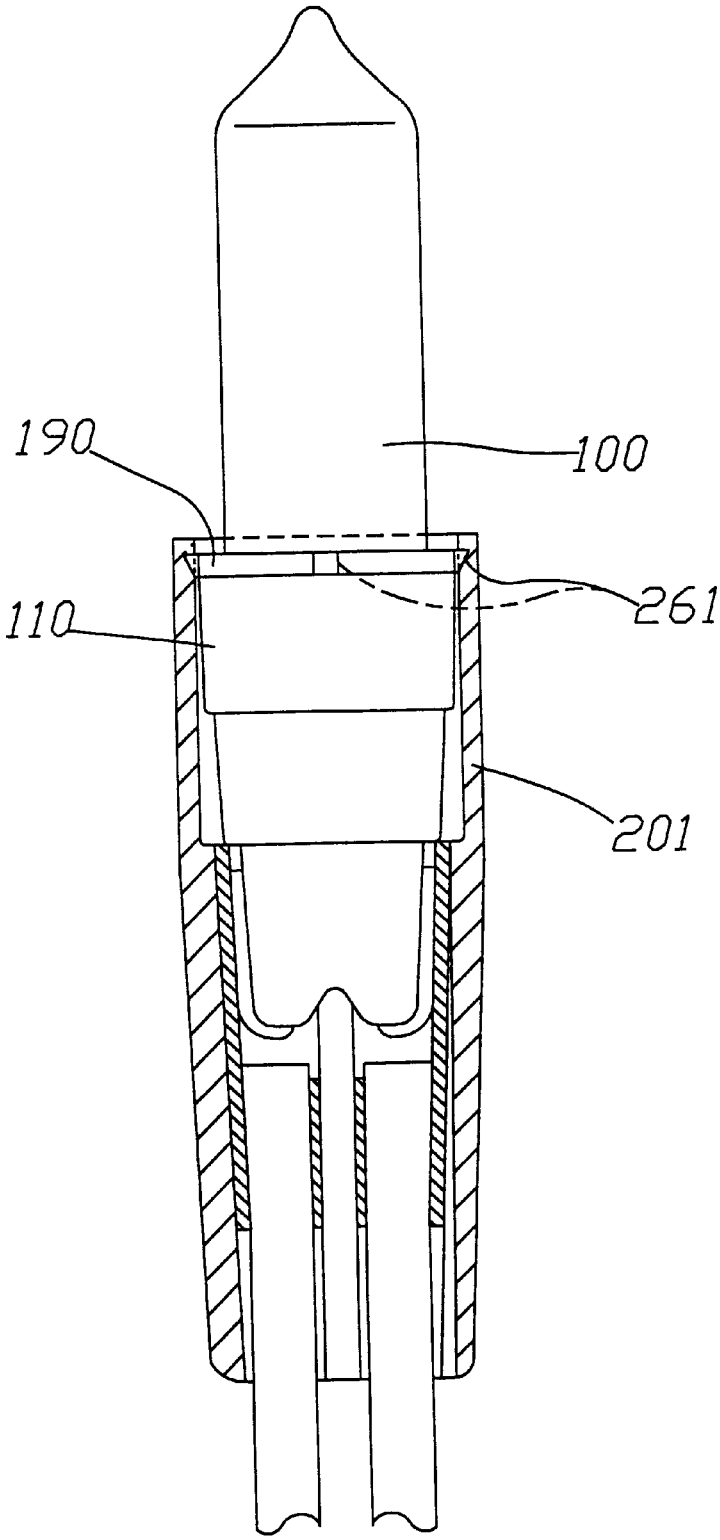
FIG. 5 is a perspective view of the third embodiment of the present invention.

In the third embodiment of the present invention as shown in FIG. 5, a lamp holder 201 is provided on the inner peripheral wall slightly beneath the top of the opening thereof with a bevel inner groove 261. A bottom connecting member 110 of a lamp bulb 100 is provided with a annular flange 190 corresponding to the bevel inner groove 261 in obliquity to form a beveled engaging portion.

Figure 6:
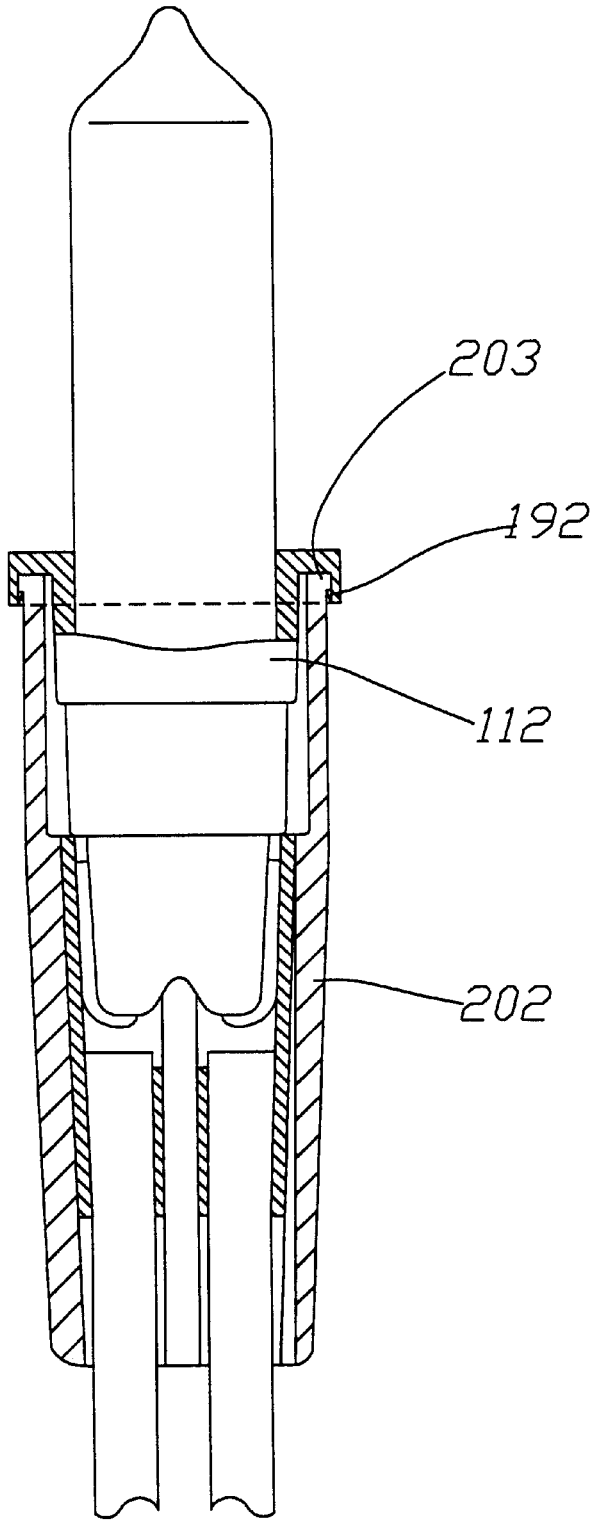
FIG. 6 is a perspective view of the fourth embodiment of the present invention.

In the fourth embodiment of the present invention as shown in FIG. 6, a lamp holder 202 is provided on the top of the opening thereof with an outer peripheral annular flange 203, a bottom connecting member 112 is provided on the upper edge thereof in corresponding to the annular flange 203 with an inversed hooking flange 192 to engage with and lock the annular flange 203.

The present invention can prevent a user to randomly detach such decorative lamp bulbs for changing, and thus prevents cases capable of inducing worries of safety.

The embodiment cited above is only for illustrating preferred embodiments of the present invention. It will be apparent to those skilled in this art that various modifications or changes can be made to the elements of the present invention without departing from the spirit and scope of this invention. Accordingly, all such modifications and changes also fall within the scope of the appended claims and are intended to form part of this invention.

What is claimed is:

1. A non-detachable structure of a lamp bulb and its lamp holder, said lamp bulb is connected in advance with a bottom connecting member, two conductors for a tungsten filament in said lamp bulb are bent and positioned onto two lateral sides of said bottom connecting member to electrically contact two metallic contact pieces on a power line when said lamp bulb is insertion connected with said lamp holder; said lamp holder is provided at the top of an opening thereof in corresponding to an upper edge of said bottom connecting member with an engaging mechanism, thereby, said lamp bulb and said bottom connecting member form safe engagement against random detachment.

2. A non-detachable structure of a lamp bulb and its lamp holder as claimed in claim 1, wherein, said engaging mechanism provided at the top of said opening of said lamp holder in corresponding to said upper edge of said bottom connecting member includes on the top of said lamp holder an inner peripheral annular rib forming an engaging shoulder; while said bottom connecting member of said lamp bulb is provided with a corresponding annular flange to be forcedly connected with said engaging shoulder.

3. A non-detachable structure of a lamp bulb and its lamp holder as claimed in claim 1, wherein, said engaging mechanism provided at the top of said opening of said lamp holder in corresponding to said upper edge of said bottom connecting member is provided on the inner periphery on said top of said lamp holder with a plurality of intermittently arranged protruding points forming an engaging shoulder; while said bottom connecting member of said lamp bulb is provided with a corresponding annular flange to be forcedly connected with said protruding points.

4. A non-detachable structure of a lamp bulb and its lamp holder as claimed in claim 1, wherein, said engaging mechanism provided at the top of said opening of said lamp holder in corresponding to said upper edge of said bottom connecting member is provided on an inner peripheral wall slightly beneath said top of said opening of said lamp holder with a bevel inner groove, said bottom connecting member of said lamp bulb is provided with a annular flange corresponding to said bevel inner groove in obliquity and forming a bevel engaging portion.

5. A non-detachable structure of a lamp bulb and its lamp holder as claimed in claim 1, wherein, said engaging mechanism provided at the top of said opening of said lamp holder in corresponding to said upper edge of said bottom connecting member is provided on the top of said lamp holder with an outer peripheral annular flange, said bottom connecting member is provided on the upper edge thereof in corresponding to said annular flange with an inversed hooking flange to engage with and lock said annular flange.

* * * * *